US009938065B2

(12) United States Patent
Farland et al.

(10) Patent No.: US 9,938,065 B2
(45) Date of Patent: Apr. 10, 2018

(54) PACKAGING FOR TOOL HANDLE WITH INTERNAL STORAGE CAVITY AND REMOVABLE CAP

(71) Applicant: Hyde Tools, Inc., Southbridge, MA (US)

(72) Inventors: Richard M. Farland, Fiskdale, MA (US); Corey Talbot, Hebron, CT (US)

(73) Assignee: HYDE TOOL, INC., Southbridge, MA (US)

( * ) Notice: Subject to any disclaimer, the term of this patent is extended or adjusted under 35 U.S.C. 154(b) by 73 days.

(21) Appl. No.: 14/868,635

(22) Filed: Sep. 29, 2015

(65) Prior Publication Data

US 2016/0096670 A1 Apr. 7, 2016

Related U.S. Application Data

(60) Provisional application No. 62/058,720, filed on Oct. 2, 2014.

(51) Int. Cl.
*B65D 55/02* (2006.01)
*B65D 71/08* (2006.01)
(Continued)

(52) U.S. Cl.
CPC ..... *B65D 79/02* (2013.01); *B65B 11/004* (2013.01); *B65D 55/06* (2013.01); *B65D 67/00* (2013.01); *B65D 71/08* (2013.01); *B65D 85/70* (2013.01); *B65D 2101/0007* (2013.01); *B65D 2203/02* (2013.01)

(58) Field of Classification Search
CPC ..... B65D 25/205; G09F 3/0292
USPC ..... 81/490, 492; 206/353, 362.4, 349, 493, 206/497, 807
See application file for complete search history.

(56) References Cited

U.S. PATENT DOCUMENTS 292,369 A 1/1884 Schluchtner
1,521,656 A 1/1925 Simpson
(Continued)

OTHER PUBLICATIONS

The HYDE 17-in-1 Painter's Tool by Hydetools. Jul. 9, 2014 [on-line] <https://www.youtube.com/watch? v=9q5sZF0BuOY. Note: video cited by private search contractors.

*Primary Examiner* — J. Gregory Pickett
*Assistant Examiner* — Allan Stevens
(74) *Attorney, Agent, or Firm* — Louis J. Franco; Law Office of Louis J. Franco

(57) ABSTRACT

A tool packaged for retail sale has a tool handle including a handle outer surface and an internal storage channel within the handle and having a channel opening facilitating selective access to the storage channel. A removable handle cap with a cap-exterior surface is installed over the channel opening in order to close off the storage channel. The handle cap is retained in place by a cap-restraining strip fabricated from a tear-resistant material. More specifically, a central portion of the cap-restraining strip is disposed over at least a portion of the cap-exterior surface, while portions of the cap-restraining strip on opposite sides of the central portion are disposed to extend along mutually opposite sides of the handle outer surface. A wrapper securely binds the portions of the cap-restraining strip located on opposite sides of the handle outer surface, thereby preventing removal of the handle cap without destruction of the wrapper.

7 Claims, 6 Drawing Sheets

(51) Int. Cl.

| | |
|---|---|
| ***B25G 1/08*** | (2006.01) |
| ***B65D 79/02*** | (2006.01) |
| ***B65B 11/00*** | (2006.01) |
| ***B65D 85/00*** | (2006.01) |
| ***B65D 67/00*** | (2006.01) |
| ***B65D 55/06*** | (2006.01) |

(56) References Cited

U.S. PATENT DOCUMENTS

| | | | | | |
|---|---|---|---|---|---|
| 2,007,685 | A | | 7/1935 | Lyle | |
| 2,447,983 | A | * | 8/1948 | Little | B65D 41/24 138/177 |
| 3,067,866 | A | | 12/1962 | Burton | |
| 3,095,103 | A | * | 6/1963 | Harrison | B65D 41/24 215/246 |
| 3,206,013 | A | | 7/1964 | Stone | |
| 3,227,268 | A | | 1/1966 | Gringer | |
| 4,166,532 | A | * | 9/1979 | Tsuchida | B65D 71/10 206/497 |
| 4,631,770 | A | * | 12/1986 | Goldberg | B25F 1/02 463/47.4 |
| 5,292,018 | A | * | 3/1994 | Travisano | B65D 55/0854 215/246 |
| 5,882,116 | A | * | 3/1999 | Backus | B65D 27/30 206/807 |
| 6,196,593 | B1 | * | 3/2001 | Petrick | G09F 3/02 283/101 |
| 6,276,725 | B1 | | 8/2001 | Laurash | |
| 7,055,680 | B2 | | 6/2006 | Liebers | |
| 7,344,118 | B2 | | 3/2008 | Samberg | |
| 8,336,710 | B2 | | 12/2012 | Chang | |
| 8,479,612 | B2 | | 7/2013 | Sergyeyenko | |
| 8,757,377 | B2 | | 6/2014 | Alexander | |
| 2004/0094000 | A1 | * | 5/2004 | Liao | B25G 1/085 81/490 |
| 2014/0346074 | A1 | | 11/2014 | Tseng | |

* cited by examiner

PACKAGING FOR TOOL HANDLE WITH INTERNAL STORAGE CAVITY AND REMOVABLE CAP

PROVISIONAL PRIORITY CLAIM

Priority based on Provisional Application, Ser. No. 62/058,720 filed Oct. 2, 2014, and entitled "PACKAGING FOR TOOL HANDLE WITH INTERNAL STORAGE CAVITY AND REMOVABLE CAP" is claimed. Moreover, the entirety of the previous provisional application, including the drawings, is incorporated herein by reference as if set forth fully in the present application.

BACKGROUND

There are hand tools having handles that are partially hollow in order to provide storage for implements associated with these tools. For example, a fastener-bit driver including a distal end defining a socket into which alternative hex-shaped screwdriver bits can be inserted for driving screws with different head types might include a handle within which there is defined a storage cavity for a plurality of fastener bits when not in use. The handle further includes a handle cap that can be removed in order to access the storage cavity and remove a stored fastener bit or introduce a fastener for storage.

Issues have arisen when such tools are displayed for sale in retail stores. For example, the caps come off unintentionally, and contents stored within the handle (e.g., bits or other implements) can fall out. Additionally, theft of the contents can also be an issue.

Accordingly, a need exists for a packaging solution that prevents unintentional dislodgement of the handle cap, and/or intentional removal of the same for purposes of theft, when a tool with a handle of the type described is displayed for retail sale.

SUMMARY

In each of variously embodied implementations, packaging is provided for a hand tool of a type including a tool handle having a handle outer surface and a handle inner surface defining within the handle an onboard internal storage channel for stowing predetermined contents. A channel opening provides access to the storage channel for the purposes of depositing contents into the channel or removing stowed items therefrom. A handle cap with a cap-exterior surface is configured for selectively closing off the channel opening and, thereby, the storage channel.

In order to prevent inadvertent dislodgement or intentional removal of the handle cap while, for example, the hand tool is displayed for sale in a retail setting, there is provided a cap-restraining strip fabricated from a tear-resistant material. In an illustrative embodiment, the cap-restraining strip has first and second panels joined to one another through a central connector portion. With the handle cap installed over the channel opening for closure of the storage channel, at least a portion of the central connector portion covers at least a portion of the cap-exterior surface, while the first and second panels extend along portions of the handle outer surface located on mutually opposite sides of the tool handle and of the handle cap. A wrapper is disposed over at least a portion of each of the first and second panels in order to securely bind the panels to the handle outer surface, thereby preventing removal of the handle cap.

The nature of the wrapper may vary among embodiments. In one version, the wrapper is comprised of a heat-activated shrink-wrap material. Some variations of the wrapper are translucent in order to allow messages displayed on at least one of the first and second panels to be seen through the wrapper. Alternatively, or additionally, the wrapper itself might include graphic and/or textual messages. In still another variation, both the wrapper and the cap-restraining material may be at least partially translucent so that a viewer can see the handle outer surface through the packaging.

In a more specific implementation, the tool handle to which the packaging is applied is an elongated tool handle that extends longitudinally along a handle-body axis between opposed handle-body front and rear ends. The handle cap closes a channel opening in the handle-body rear end. Additionally, the cap-exterior surface that is at least partially covered by at least a portion of the central connector portion is a rearwardly-facing surface as defined with respect to the handle-body front and rear ends. In a still-more-specific implementation, the handle cap includes a cap hole which, when the handle cap is installed on the handle to close the channel opening, extends laterally relative to the handle-body axis. Thus installed, the cap hole is defined in part by the rearwardly-facing cap-exterior surface that is engaged and retained by the central connection portion of the cap-restraining strip.

Representative embodiments are more completely described and depicted in the following detailed description and the accompanying drawings.

DETAILED DESCRIPTION

The following description of variously embodied tool packaging and methods of tool packaging is demonstrative in nature and is not intended to limit the invention or its application of uses. Accordingly, the various implementations, aspects, versions and embodiments described in the summary and detailed description are in the nature of non-limiting examples falling within the scope of the appended claims and do not serve to define the maximum scope of the claims. Equally important, an illustrative tool onto which packaging falling within the scope and contemplation of the invention can be applied is shown and described only for the purposes of providing context and an illustrative environment for implementations of the invention and, therefore, unless otherwise specifically recited as an element of one or more claims, does not constitute a part of the invention itself.

Figure 1:
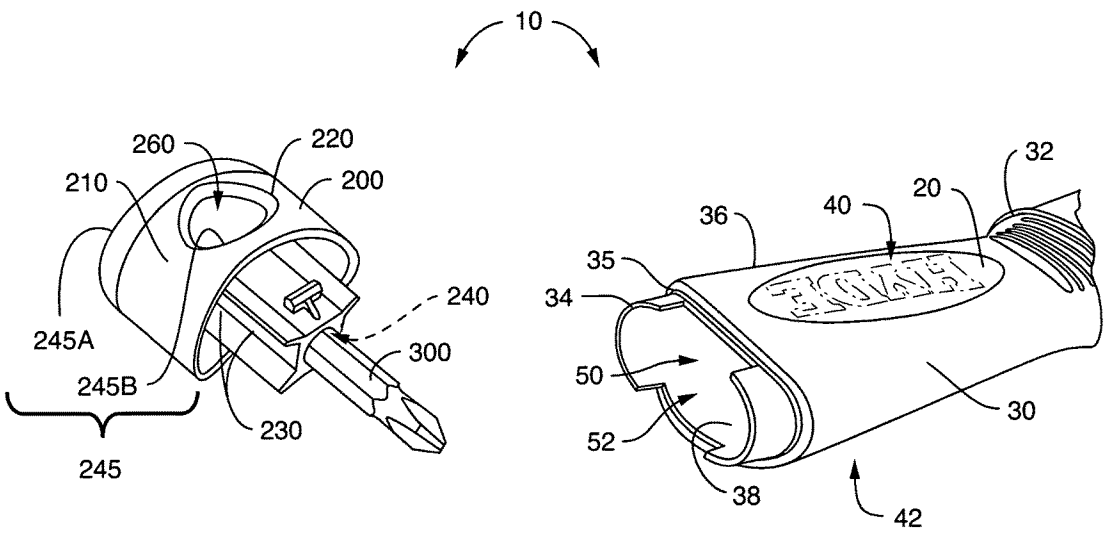
FIG. 1 is a partial view of a tool including a tool handle having an internal storage channel and a handle cap for closing the storage channel.
Figure 2:
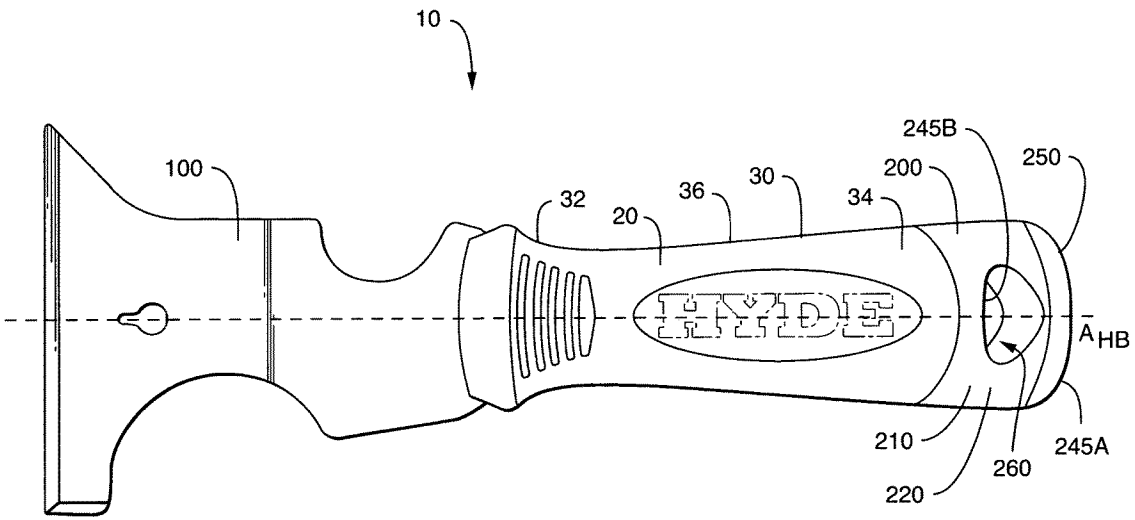
FIG. 2 is a full-length view of the tool of FIG. 1 with the handle cap installed for closure of the storage channel.

With initial reference to FIGS. 1 and 2, a tool 10—in this case, a scraper—includes an elongated tool handle 20; a blade 100 fixedly retained by, and depending forwardly of, the tool handle 20; and a selectively removable handle cap 200. The tool handle 20 comprises an elongated handle body 30 that extends longitudinally along a handle-body axis $A_{HB}$ between opposed handle-body front and rear ends 32 and 34. At least one side wall 35 defines a handle outer surface 36 and opposed first and second handle sides 40 and 42 that extend between the front and rear ends 32 and 34 and are configured for gripping by the hand of a user. The side wall 35 of the tool handle 20 further includes an inner surface 38 that defines an internal storage channel 50 (alternatively referred to as internal storage cavity 50).

The storage channel 50 extends from a channel opening 52 in the handle-body rear end 34 toward the handle-body front end 32. The channel opening 52 of the storage channel 50 can be closed with the handle cap 200. Moreover, the channel 50 and handle cap 200 are cooperatively configured for purposes described below.

With continued reference to FIGS. 1 and 2, in addition to being configured for selectively capping the channel opening 52 in the handle-body rear end 34, the handle cap 200 can, in some embodiments, be used as a fastener driving tool. More specifically, as depicted in FIGS. 1 and 2, the handle cap 200 includes a, cap-exterior surface 210 for grasping by a user. At least a portion of the cap-exterior surface 210 is configured to define a knob portion 220 in order to facilitate the user's grasp. Additionally, the handle cap 200 has an internal surface 230 defining a fastener-bit socket 240 into which a fastener bit 300 can be inserted for selective retention.

The internal storage cavity 50 facilitates "on-board" storage of tools (e.g., implements) such as extra bits 300, by way of non-limiting example. However, as previously indicated, the details of any specific tool with which the packaging solution is applied are not relevant, as the packaging may be applied to a tool handle 20 with a storage channel 50 that can be closed off by a handle cap 200. Illustratively, other tools to which the packaging could be alternatively applied include (i) fastener drivers, such as screwdrivers and socket wrenches, and (ii) hammers, by way of non-limiting example.

When the handle cap 200 is installed to close off the channel opening 52 in the handle-body rear end 34, the handle cap 200 exhibits at least one rearwardly-facing surface 245. The handle cap 200 depicted includes a cap hole 260 extending laterally (relative to the handle-body axis $A_{HB}$) through the knob portion 220. Accordingly, this handle cap 200 exhibits two rearwardly-facing surfaces 245. A first rearwardly-facing surface 245A is situated on a butt end 250 of the handle cap 200, while a second rearwardly-facing surface 245B is situated within, and defines part of, the cap hole 260. The cap hole 260 can be used to hang the tool 10 on a hook, nail or peg, for example. In any event, a cap hole 260 figures into most embodiments and implementations of the present packaging solution.

Figure 3:
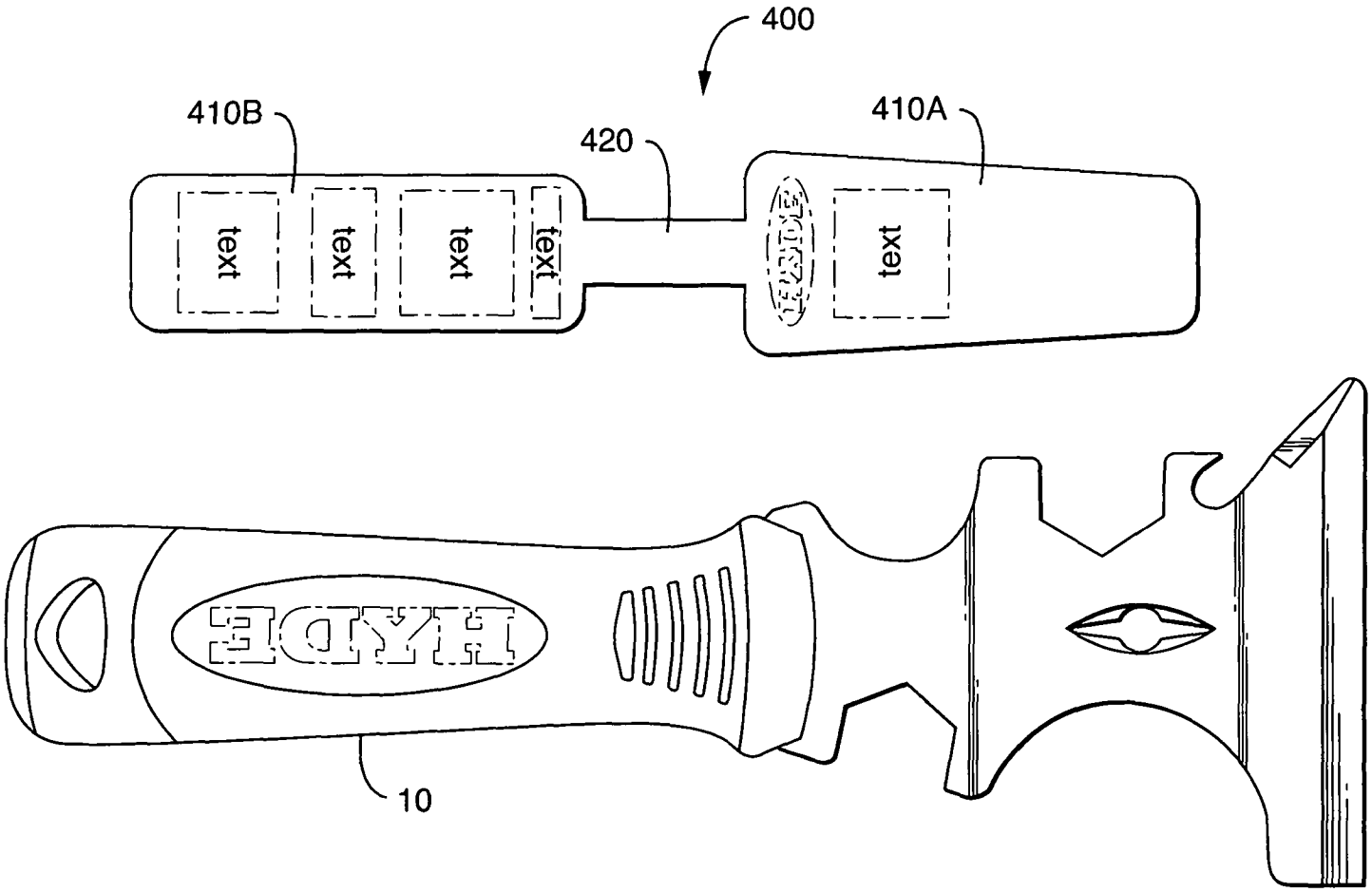
FIG. 3 is a full-length view of a tool similar to that of FIG. 1 set alongside a cap-restraining strip used in the implementation of a packaging solution.

Referring now to FIG. 3, an illustrative packaging method employs a cap-restraining strip 400 of flexible, tear-resistant material, such as fiber-reinforced paper, metal, vinyl, PVC or another polymeric material, by way of non-limiting example. The cap-retraining strip 400 includes first and second panels 410A and 410E joined to one another through a central connector portion 420. In the embodiment depicted, the central connector portion 420 is narrower than the first and second panels 410A and 410B for reasons that will become apparent relative to the particular tool 10 depicted, but this need not be the case.

Figure 4:
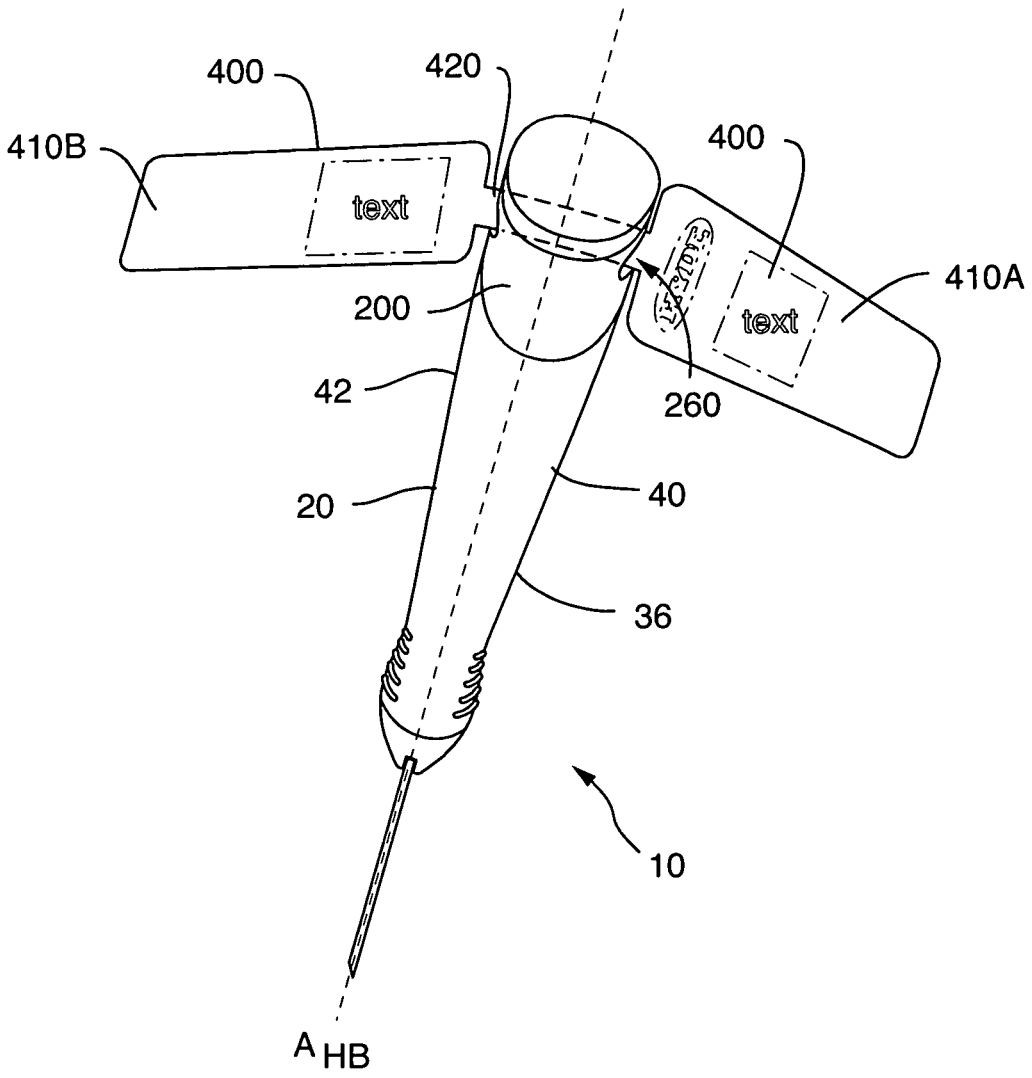
FIG. 4 shows the tool and cap-restraining strip of FIG. 3 wherein the cap-restraining strip is fed partway through the laterally-extending cap hole in the handle cap, and a portion of the cap-restraining strip on either side of the tool handle is in the process of being flexed to extend along a portion of the handle.

With reference to FIG. 4, one packaging method includes passing one of the first and second panels 410A and 410B through the cap hole 260. With the handle cap 200 installed on the tool handle 20 so that it closes off the channel opening 52, and at least a portion of the central connector portion 420 situated within the cap hole 260, the first and second panels 410A and 410B are then positioned (e.g., folded down or bent relative to the central connector portion 420) so that they extend along opposed portions (e.g., opposite first and second sides 40 and 42) of the handle outer surface 36. The first and second panels 410A and 410E are then bound in their respective positions along the handle outer surface 36. Binding of the panels 410A and 410B to the tool handle 20, and contacting engagement between the central connector portion 420 and a rearwardly-facing surface 245 of the handle cap 200, prevents ready removal of the handle cap 200.

Figure 5:
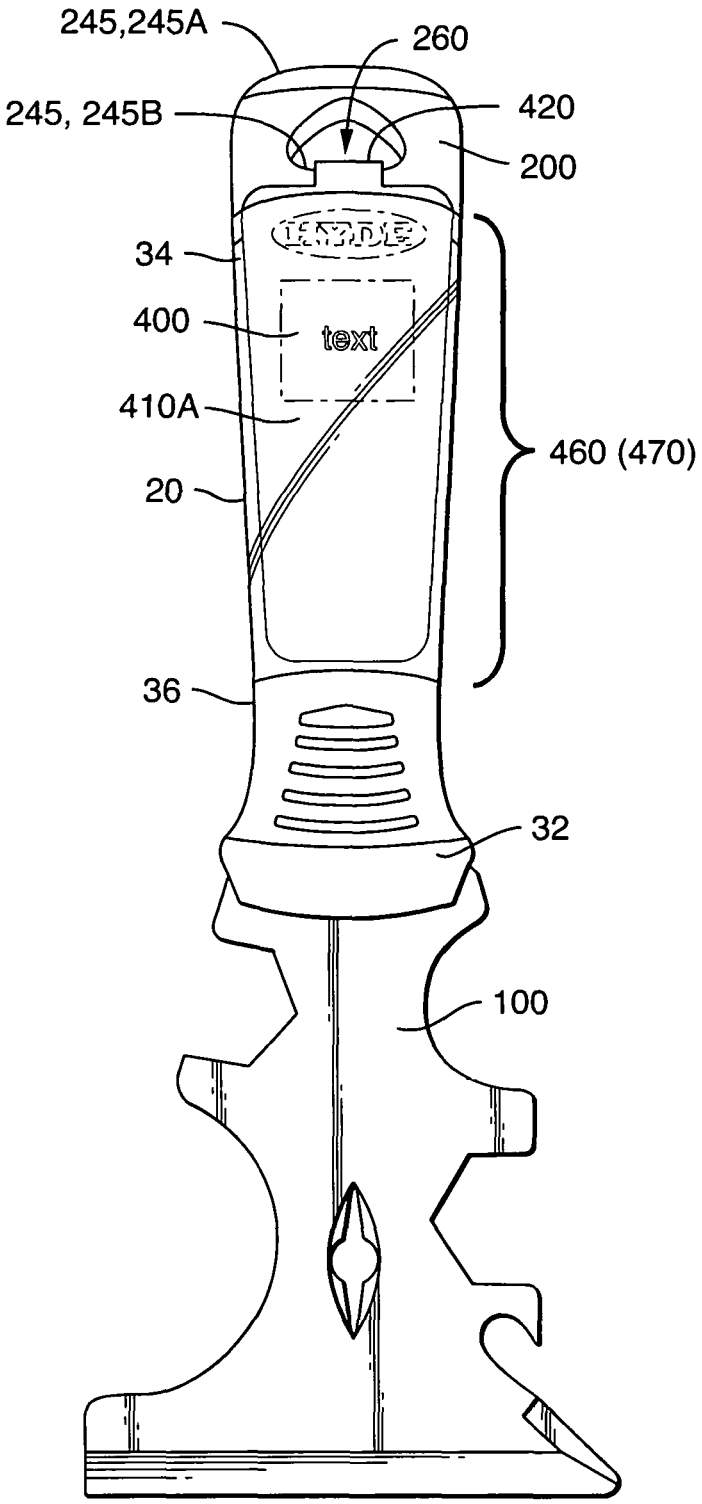
FIG. 5 shows the tool of FIGS. 3 and 4 wherein a form-fitting wrapper has been disposed over the tool handle and the portions of the cap-restraining strip disposed along opposite sides of the tool handle in order to prevent removal of the handle cap.

In the implementation depicted in FIG. 5, the central connector portion 420 is passed through the cap hole 260 for contacting restraint opposing the rearward movement of the second rearwardly-facing surface 245B of the handle cap 200 relative to the tool handle 20. However, a similar result can be achieved by wrapping the cap-restraining strip 400 around the butt end 250 of the handle cap 200 so that the central connector portion 420 bears against the first rearwardly-facing surface 245A. Because the latter version can be readily understood by examination of the existing drawings and the foregoing explanation, figures depicting it are omitted for the sake of brevity.

According to one method described with continued reference to FIG. 5, the panels 410A and 410B are bound to the tool handle 20 using a wrapper 460 of translucent material, such as plastic. Use of a translucent material to bind the panels 410A and 410B allows textual and/or graphical messages displayed on at least one of the first and second panels 410A and 410B to be seen through the panel-binding material. Among the illustrative messages that might be displayed on one or both of the first and second panels 410A and 410B are (i) a bar code, (ii) product number/UPC code, (iii) a logo or trademark, (iv) an indication as to contents included within the storage channel 50 at the point of sale, and (v) a tool name, by way of non-limiting example.

Figure 5A:
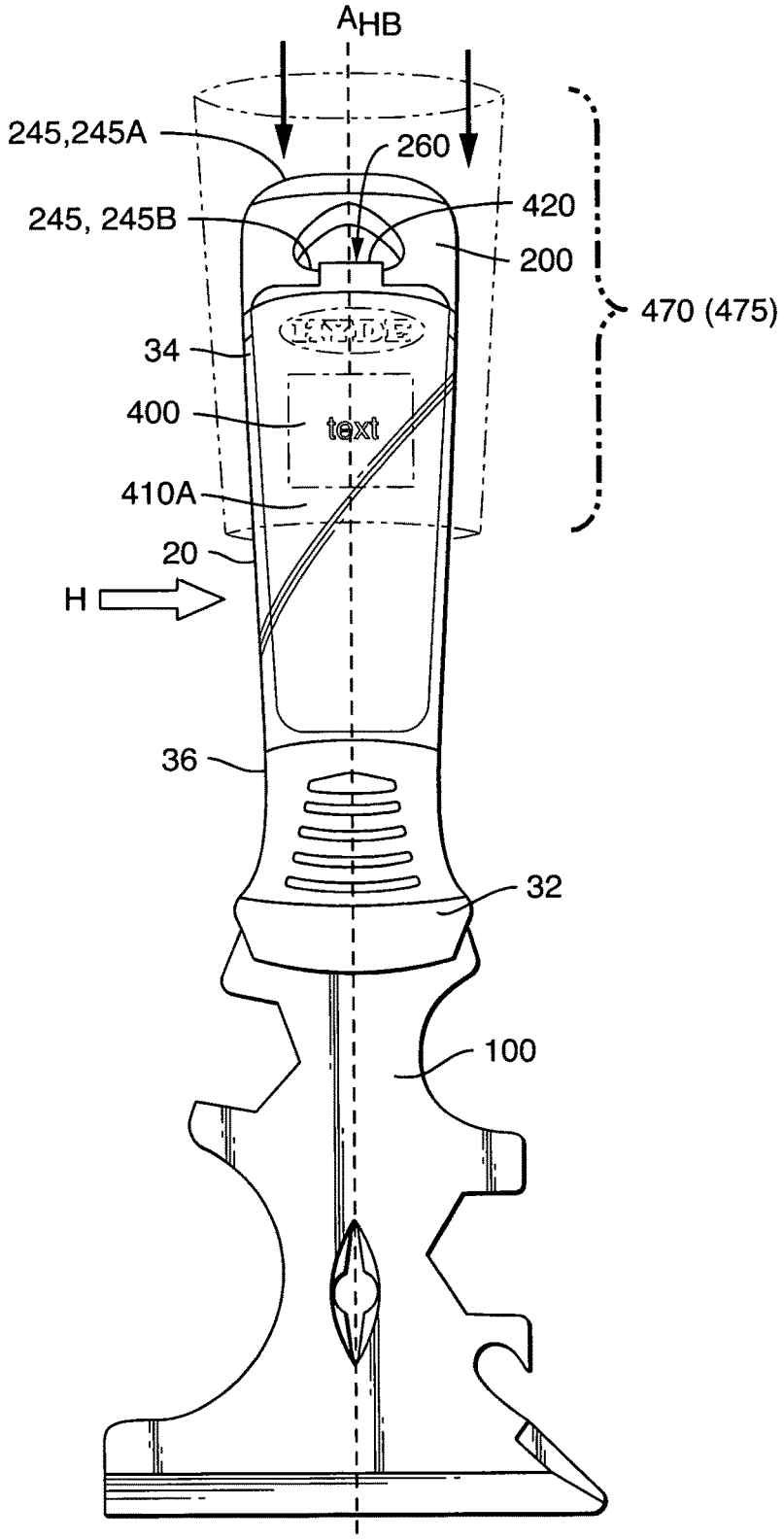
FIG. 5A shows a packaging process step in which an illustrative wrapper sleeve of heat-activated shrink-wrap material is being axially disposed about the handle and the cap-restraining strip prior to the application of heat in order to shrink the wrapper about the handle and cap-restraining strip.

In various implementations, the panels 410A and 410B are securely bound to the tool handle 20 by a "form-fitting" heat-activated shrink-wrap material 470. FIG. 5A illustrates steps in which the shrink-wrap material 470 is in the form of a tube or sleeve 475. However, implementations in which the shrink-wrap material 470 is alternatively configured as a sheet, band or bag, for example, are within the scope and contemplation of the invention. With the first and second panels 410A and 410B extending along opposite sides of the tool handle 20, a sleeve 475 of shrink-wrap material 470 is axially (i.e., relative to the handle-body axis $A_{HB}$) introduced over at least a portion of the length of the tool handle 20 such that at least a portion of each of the panels 410A and 410B is situated between the handle outer surface 36 and the sleeve 475. Once the shrink-wrap material 470 is in a predetermined axial position, heat H is applied to the shrink-wrap material 470 so that it shrinks and constricts about the tool handle 20. The constriction of the shrink-wrap material securely binds the panels 410A and 410B between the tool handle 20 and shrink-wrap material 470. FIG. 5 shows the packaging solution after the shrink-wrap material 470 has been constricted in a manner generally consistent with the steps described in conjunction with FIG. 5A.

The foregoing is considered to be illustrative of the principles of the invention. Furthermore, since modifications and changes to various aspects and implementations will occur to those skilled in the art without departing from the scope and spirit of the invention, it is to be understood that the foregoing does not limit the invention as expressed in the appended claims to the exact constructions, implementations and versions shown and described.

What is claimed is:

1. A method of packaging a tool with (i) a tool handle extending along a handle-body axis and having a handle outer surface and handle inner surface defining within the tool handle an onboard internal storage channel for stowing predetermined contents and (ii) a handle cap having a cap-exterior surface and being configured for selectively closing the storage channel, the method comprising:

providing a cap-restraining strip fabricated from a tear-resistant material, the cap-restraining strip having first and second panels joined to one another through a central connector portion;

positioning the cap-restraining strip relative to the tool handle such that, with the handle cap installed for closure of the storage channel, at least one portion of the central connector portion covers at least one portion of the cap-exterior surface and the first and second panels extend along portions of the handle outer surface located on mutually opposite sides of the tool handle; and wrapping the first and second panels in order to securely bind the panels to the handle outer surface, thereby preventing removal of the handle cap; wherein, the at least one portion of the cap-exterior surface which is covered by at least one portion of the central connector portion is situated within, and partially defines, a cap hole that extends laterally through the handle cap, when installed, relative to the handle-body axis.

2. The method of claim 1 wherein (i) the tool handle is an elongated tool handle that extends longitudinally along the handle-body axis between opposed handle-body front and rear ends; (ii) the handle cap closes a channel opening in the handle-body rear end; and (iii) the cap-exterior surface that is at least partially covered by the at least one portion of the central connector portion is a rearwardly-facing surface as defined with respect to the handle-body front and rear ends.

3. The method of claim 2 wherein the wrapping use of a translucent, heat-activated shrink-wrap material in order to allow messages displayed on at least one of the first and second panels to be seen through the shrink-wrap material.

4. A packaged tool comprising:

a tool handle extending along a handle-body axis and having a handle outer surface and a handle inner surface defining within the tool handle an internal storage channel for stowing predetermined contents, the storage channel including a channel opening;

a handle cap installed over the channel opening in order to close the storage channel, the handle cap having a cap-exterior surface;

a tear-resistant cap-restraining strip, the cap-restraining strip having first and second panels joined to one another through a central connector portion and being disposed such that (i) at least one portion of the central connector portion covers at least one portion of the cap-exterior surface and (ii) the first and second panels extend along portions of the handle outer surface located on mutually opposite sides of the tool handle; and a wrapper securely binding the first and second panels to the handle outer surface, thereby preventing removal of the handle cap; wherein, (i) the cap-restraining strip and the wrapper as applied to the tool handle and handle cap constitute packaging, and (ii) the cap-exterior surface is situated within, and partially defines, a cap hole that extends laterally through the handle cap, when installed, relative to the handle-body axis.

5. The packaged tool of claim 4 wherein (i) the tool handle to which the packaging is applied is an elongated tool handle that extends longitudinally along the handle-body axis between opposed handle-body front and rear ends; (ii) the handle cap closes the channel opening in the handle-body rear end; and (iii) the at least one portion of the cap-exterior surface that is covered by the at least one portion of the central connector portion is a rearwardly-facing surface as defined with respect to the handle-body front and rear ends.

6. The packaged tool of claim 5 wherein the wrapper comprises heat-activated shrink-wrap material.

7. The packaged tool of claim 4 wherein the wrapper comprises heat-activated shrink-wrap material.

* * * * *